US005979954A

United States Patent [19]

Tsui et al.

[11] Patent Number: 5,979,954

[45] Date of Patent: Nov. 9, 1999

[54] SAFETY HOIST RING

[75] Inventors: Gary Tsui, San Gabriel; Tony J. Alba, West Covina, both of Calif.

[73] Assignee: CBC Industries, Inc., Commerce, Calif.

[21] Appl. No.: 09/016,134

[22] Filed: Jan. 30, 1998

[51] Int. Cl.[6] ..... B66C 1/66

[52] U.S. Cl. ..... 294/1.1; 294/89; 403/78; 403/164

[58] Field of Search ..... 294/1.1, 82.1, 294/89; 403/78, 79, 164; 411/400, 401, 402, 403, 384, 388

[56] References Cited

U.S. PATENT DOCUMENTS

| | | | |
|---|---|---|---|
| 1,352,665 | 7/1920 | Healy | 294/89 |
| 1,642,958 | 9/1927 | Joyner | 294/82.1 |
| 3,492,033 | 1/1970 | Mueller | 403/78 |
| 4,558,979 | 12/1985 | Andrews | 294/1.1 |
| 4,570,987 | 2/1986 | Wong et al. | 294/1.1 |
| 4,705,422 | 11/1987 | Tsui et al. | 294/1.1 |
| 5,286,130 | 2/1994 | Mueller | 294/1.1 |
| 5,609,454 | 3/1997 | Lee | 411/384 |
| 5,848,815 | 12/1998 | Tsui et al. | 294/1.1 |

*Primary Examiner*—Dean J. Kramer
*Assistant Examiner*—Paul Chin
*Attorney, Agent, or Firm*—Bruce A. Jagger

[57] ABSTRACT

An improved safety hoist ring assembly. Fewer and simpler parts are used in the assembly, as compared with the prior art safety hoist rings. It can be easily assembled and disassembled without the use of tools. The assembly includes a lift stud member, a bushing member, a retainer element, a U-bar member and a clevis pin element. The cylindrical bearing surface of the lift stud member is axially received in and retained within the central bore of the bushing member by the retainer element. The external diameter of the retainer element is less than the external diameter of the bushing member. The retainer element is thus sized to pass through any bore in an object to which the bushing member is to be attached. The external surface of the bushing member is provided with some mounting mechanism, such as a thread, which mounts the bushing to an object which is to be lifted. The lateral movement of the lift stud member is restrained by seating a radial flange of the lift stud member into a circular recess in the mating surface of the bushing member. The U-bar member includes two opposed legs having bores that are in axial alignment. The clevis pin element engages the bores of the opposed legs and a load bearing bore in the enlarged end, thereby pivotally attaching the U-bar member to the lift stud member.

4 Claims, 2 Drawing Sheets

SAFETY HOIST RING

BACKGROUND OF THE INVENTION

1. Field of the Invention

The invention relates in general to hoist ring assemblies and, in particular, to an improved high strength, low cost, self-contained safety hoist ring which can be assembled and disassembled without the use of tools.

2. Description of the Prior Art

Hoist ring assemblies have been widely used throughout industry to provide for quick attachment to heavy objects desired to be lifted by such tools as cranes and jacks. Hoist ring assemblies are generally considered to be critical safety items because if a failure occurs, a heavy object may be dropped resulting in damage to people, the object, and its surroundings.

There are a variety of hoist ring assemblies having different swivel capabilities for particular applications. One variety is capable of swiveling throughout a complete 360 degree arc, and at the same time capable of being swung throughout an arc of substantially 180 degrees in a direction perpendicular to the 360 degree swivel arc, irrespective of the manner in which the hoist ring is attached to the load. A hoist ring assembly having this swiveling capability is herein referred to as a safety hoist ring.

For economic reasons it is desirable to produce safety hoist rings having a minimal number of easily formed parts. Previous safety hoist rings generally included numerous parts. See, for example, Tsui et al., U.S. Pat. No. 4,705,422, which discloses a safety hoist ring comprising 10 parts. Ease and speed of assembly and disassembly have not been a design priority with many prior safety hoist rings. See, for example, U.S. Pat. No. 4,705,422, which discloses a safety hoist ring which includes three snap rings which require the use of a snap ring tool to assemble and disassemble the hoist ring. Those concerned with these problems recognize the need for an improved, lower cost, safety hoist ring consisting of a minimum number of parts that can be easily assembled and disassembled without the need of special tools.

These and other difficulties of the prior art have been overcome according to the present invention.

BRIEF SUMMARY OF THE INVENTION

A preferred embodiment of the safety hoist ring according to the present invention comprises a number of members and elements including, a lift stud member, a bushing member, a retainer element, a U-bar member, and a clevis pin element. The lift stud has an enlarged end, a securing end, and a generally cylindrical bearing surface extending between the securing end and the enlarged end. Preferably, the lift stud is unitary. The cylindrical bearing surface of the lift stud generally terminates adjacent the enlarged end in an outwardly radially extending flange. This radial flange generally forms the base of the enlarged end of the lift stud. The enlarged end of the lift stud includes a load engaging member such as, for example, a transverse load bearing bore. This transverse bore receives the clevis pin and thereby mounts the U-bar to the lift stud. The cylindrical bearing surface is axially received in the bushing. When so received the lift stud is rotatable about its longitudinal axis within the bushing. The bushing includes an external workpiece engaging element such as, for example, an externally threaded generally cylindrical surface which is adapted to threadably secure the hoist ring to an object which is intended to be lifted, or a locking ramp which is adapted to lockingly engage a mating ramp on the object, or a quick release member, or the like. The retainer attaches to the securing end of the lift stud. The securing end is generally remote from the enlarged end with the cylindrical bearing surface extending therebetween. The engagement of the retainer with the securing end serves to retain the lift stud within the bushing. The retainer is not, however, drawn tight against the bushing. The lift stud is thus free to rotate about its longitudinal axis within the bushing when in the assembled configuration.

The outside diameter of the retainer is preferably less than the outside diameter of the threaded portion of the bushing. The fully assembled safety hoist ring can thus be mounted to a workpiece by inserting the assembly into a tapped hole which threadably engages the bushing.

When the bushing is threadably fixed to an object to be lifted, the lift stud is free to swivel throughout a complete 360 arc with respect to the bushing. The U-bar has two opposed load bearing legs, each leg has a bore generally adjacent its free end, and the bores are generally in axial alignment. The clevis pin engages the bores of the U-bar and the load bearing bore of the lift stud. With the clevis pin engaged in the bores, the U-bar is capable of being swung throughout an arc of substantially 180 degrees in a direction perpendicular to the 360 degree swivel arc.

In one embodiment, the clevis pin threadably engages one of the bores of the U-bar and a groupable head is provided on the clevis pin to allow for quick hand assembly and disassembly of the U-bar to the lift stud. The retainer is preferably provided with a knurled surface which provides a firm gripping surface to allow quick hand assembly or disassembly of the lift stud to the bushing. Complete assembly and disassembly of the hoist ring can be accomplished without the use of tools.

In one embodiment the radial flange of the lift stud seats into a circular recess provided in the mating end surface of the bushing. The load bearing capacity of the safety hoist ring is thus enhanced as compared to those embodiments where the mating surfaces of the radial flange and the bushing are generally flat and normal to the longitudinal axis of the lift stud.

The manufacturing costs of the safety hoist ring of the present invention are minimized because there are few parts, and they are of simple design and construction. The present safety hoist ring can also be quickly assembled or disassembled by hand without the need of any special tools. Assembly costs are thus reduced. It is impossible to assemble it incorrectly. It is readily inspected to determine that the parts are in proper working order. The ease of disassembly and assembly encourages workers in the field to perform safety inspections on these devices.

Other objects, advantages, and novel features of the present invention will become apparent from the following detailed description of the invention when considered in conjunction with the accompanying drawings.

BRIEF DESCRIPTION OF THE DRAWINGS

The present invention provides its benefits across a broad spectrum of hoist ring assemblies and in particular to safety hoist rings. While the description which follows hereinafter is meant to be representative of a number of such applications, it is not exhaustive. As those skilled in the art will recognize, the basic apparatus taught herein can be readily adapted to many uses. It is applicant's intent that this specification and the claims appended hereto be accorded a breadth in keeping with the scope and spirit of the invention being disclosed despite what might appear to be limiting language imposed by the requirements of referring to the specific examples disclosed.

Referring particularly to the drawings for the purposes of illustration only and not limitation.

DETAILED DESCRIPTION OF THE PREFERRED EMBODIMENTS

Figure 1:
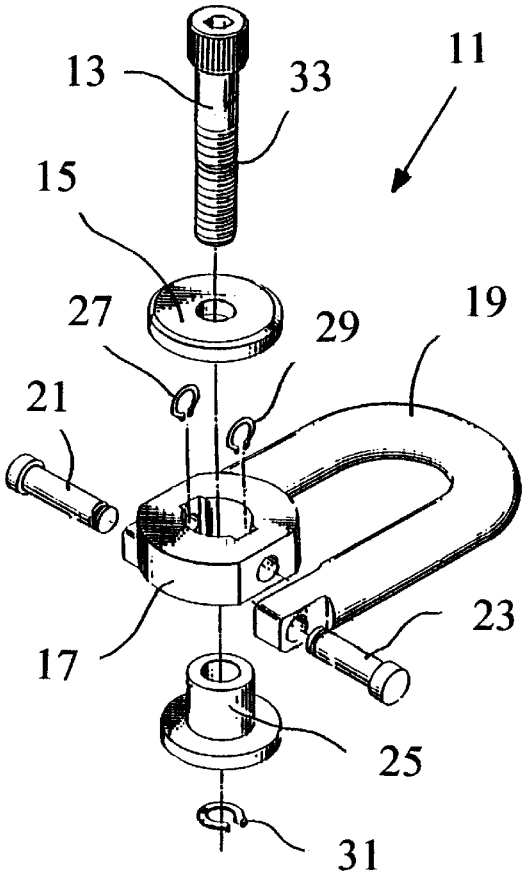
FIG. 1 is an exploded isometric view of a prior art safety hoist ring.

Referring now to the drawings wherein like reference numerals designate identical or corresponding parts throughout the several views, in FIG. 1 generally at 11, a prior art safety hoist ring is indicated. The prior art safety hoist ring 11 consists of ten parts, namely, a bolt or screw 13, a washer 15, a ring member or body 17, a U-bar 19, two pivot pins 21 and 23, a bushing 25, and three snap rings 27, 29, and 31. When assembled, the bolt 13 of this prior art safety hoist ring is threadably attached to an internally threaded bore in a heavy object which is to be lifted. Ring member 17 is free to swivel a complete 360 degrees about the centerline of the bolt 13, while the U-bar 19 is generally capable of swiveling throughout an arc of substantially 180 degrees in a direction perpendicular to the 360 degree swivel arc of the ring member 17. The prior art safety hoist ring utilizes a number of parts in obtaining the 360 degree swivel arc and perpendicular 180 degree arc, several of which require considerable effort to form them. The body 17, for example, requires several machining operations to make it. Assembly and disassembly requires some knowledge, skill and tools. For example, snap ring 31, which is somewhat hidden in a recess in the bottom of the hoist ring, must be removed from groove 33 in bolt 13. Even after removing the snap ring 31, the other snap rings 27 and 29 must also be removed to release the shoulder pins 21 and 23. The snap rings 27 and 29 generally require some skill to remove and install due to the limited space within the ring member 15 where they reside. It is recommended to use a special snap ring tool specifically designed to work in areas of limited space to remove the snap rings. Although the prior art safety hoist ring 11 functions adequately in swiveling in the two separate arcs, it is unnecessarily expensive to manufacture due to the numerous parts and their complexity, and requires skill, time and tools to assemble and disassemble.

Figure 2:
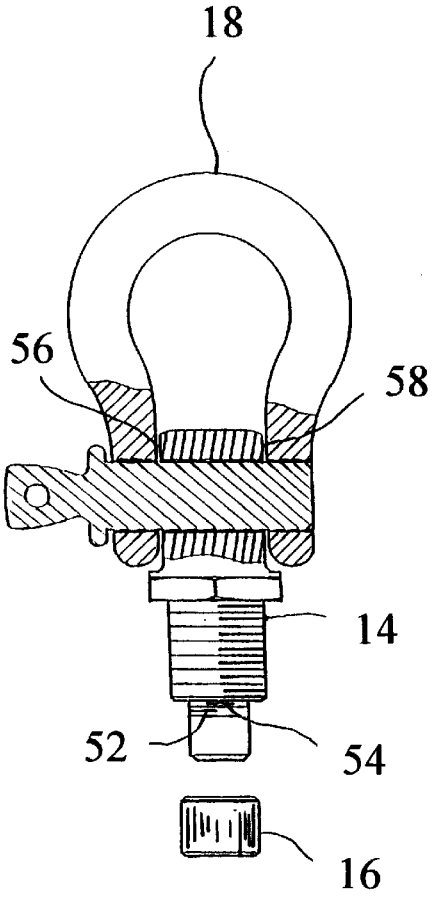
FIG. 2 PRIOR ART
FIG. 2 is a partial cross section view of a preferred embodiment of the present invention.
Figure 3:
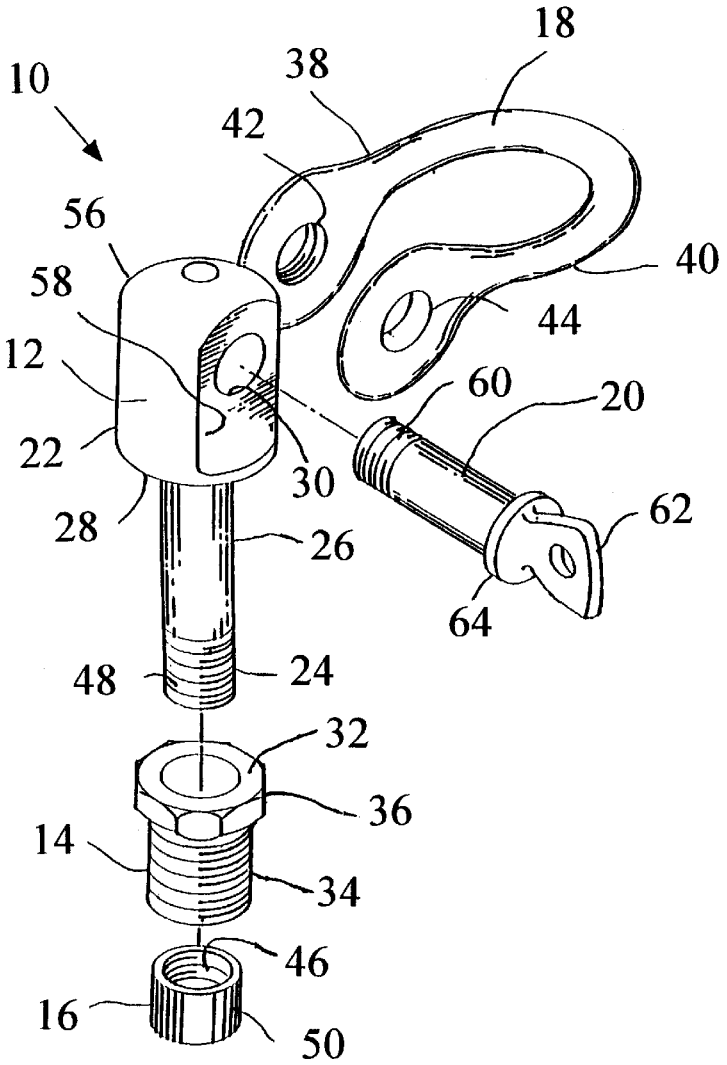
FIG. 3 is an exploded isometric view of the embodiment of FIG. 2.
Figure 4:
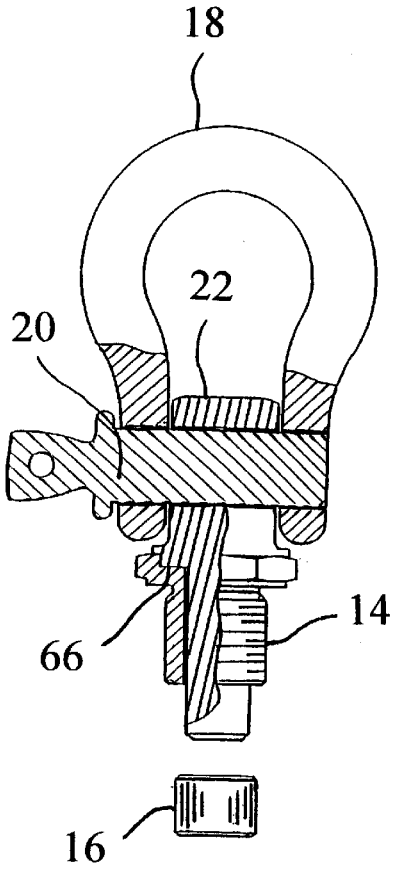
FIG. 4 is a partial cross section view of another preferred embodiment of the present invention.

Referring particularly to FIGS. 2, 3 and 4, there is illustrated generally at 10, a safety hoist ring of the present invention. The safety hoist ring of the present invention has the same swivel capabilities as the prior art safety hoist ring, but it is comprised of fewer and simpler parts. The safety hoist ring 10 includes a lift stud 12, a bushing 14, a retainer 16, a U-bar 18, and a clevis pin 20.

The lift stud 12 has an enlarged end 22, a securing end 24, a generally cylindrical bearing surface 26 extending between the securing end 24 and the enlarged end 22, and a generally radial flange 28 forming the bottom of enlarged end 22. Flange 28 extends generally normal to the axis of the cylindrical bearing surface 26. The enlarged end 22 includes a transverse load bearing bore 30 for mounting the U-bar 18 to the lift stud 12 with the clevis pin 20.

The generally cylindrical bearing surface 26 is axially received in and pivotally engaged with the generally axial bore of bushing 14. Although a cylindrical form is preferred for these mating parts, slightly conical configurations are contemplated within the description of "generally cylindrical". The end surface 32 of the bushing 14 is in mating engagement with the surface of flange 28. The bushing 14 includes an externally threaded surface 34 (straight or tapered), and hex head 36. The threaded surface 34 is adapted to threadably secure the hoist ring to an object which is intended to be lifted.

The retainer 16 attaches to the securing end 24 of the lift stud 12 and captively retains the bushing 14 between the flange 28 and the retainer. Preferably, the outside diameter of bushing 14 is greater than the outside diameter of retainer 16 so that retainer 16 will pass freely through any internally threaded bore which will threadably engage with threaded surface 34.

The U-bar 18 has two opposed load bearing legs 38 and 40. Legs 38 and 40 have bores 42 and 44, respectively, which are generally in axial alignment with one another. The U-bar 18 is pivotally secured to the lift stud 12 by the clevis pin 20. The clevis pin engages both bores 42 and 44 and also the load bearing bore 30 of the lift stud 12.

In a preferred embodiment referred to for purposes of illustration only and not limitation, the retainer 16 includes internal threads 46 and the securing end 24 includes matching external threads 48. When assembled, the retainer 16 is threadably engaged with the securing end 24 which captively and rotatably retains the bushing 14 around the cylindrical bearing surface 26. The bushing 14 freely rotates through 360 degrees normal to the central axis of the generally cylindrical bearing surface.

To allow for the quick assembly and disassembly of the hoist ring without the use of tools, retainer 16 is provided with a knurled surface 50 to enable the operator to achieve a firm grip when removing or installing the retainer. To prevent retainer 16 from unscrewing from securing end 24, the two threads, 52 and 54, next to the cylindrical bearing surface 26 are deformed so as to allow the retainer to jam in place on the lift stud. Other methods of preventing the retainer 16 from unscrewing from the securing end 24 are contemplated, for example, a cotter pin could be inserted into a through hole provided in both the retainer and the securing end.

Any method of captively retaining the lift stud within the bushing must be capable of supporting the lifting load. The preferred embodiment in FIGS. 2 and 3 shows the retainer functioning essentially as a nut and the securing end functioning essentially as a bolt. The lifting load is transferred across internal and external threads 46 and 48. Other methods of retaining the bushing and supporting the lifting load are contemplated, for example, the securing end could function essentially as a nut and the retainer could essentially function as a bolt.

In a preferred embodiment, generally parallel flats 56 and 58 are formed generally normal to the axis of the load bearing bore 30 on the enlarged end 22 of the lift stud. These flats act to help prevent a lifting member, such as a cable or rope, from binding between the U-bar and the lift stud when the lifting member is inserted into the hoist ring to lift an object. Threads 60 are provided on one end of the clevis pin 20 and the bore 42 is match threaded to accept threads 60. At the other end of clevis pin 20 is an integral knob 62 and flange 64 adapted to allow an operator to attach or detach the U-bar from the hoist ring by turning the knob by hand.

Although an object of the present invention is to provide a safety hoist ring which can be assembled or disassembled without the use of tools, or with only the most basic of tools, such as, for example, a pair of pliers, other configurations of the clevis pin are contemplated. Such additional configurations include, for example, a hex head substituted in place of the knob, or a snap ring to secure the clevis pin 20 in the assembled configuration. Although other methods are contemplated, they are generally no more desirable than that shown in the preferred embodiment because they generally require the use of special tools to assemble or disassemble the hoist ring.

Another embodiment of the present invention is shown in FIG. 4. In FIG. 4, the bushing 14 has a circular recess 66 which receives the flange 28 of the lift stud 12. Flange 28 protrudes from the enlarged end 22 to seat in the circular recess 66 of the bushing 14. By reason of seating the flange into the circular recess in the end of the bushing, the load capacity of this embodiment of the present invention is comparatively greater than the embodiments previously discussed. The lateral movement of the lift stud member is restrained by the engagement of the outer peripheral side of the flange with the circumferential wall of the circular recess.

All five parts comprising the improved safety hoist ring can be made from a variety of different materials. Material selection depends on many factors such as size, design load, and the like. Preferably all five parts are made of steel.

What has been described are preferred embodiments. Many modifications and variations of the present invention are possible in light of the above teachings. It is therefore to be understood that, within the scope of the claims, the invention may be practiced otherwise than as specifically described.

What is claimed is:

1. A hoist ring assembly capable of swiveling throughout a complete 360 degree arc and simultaneously capable of being swung throughout an arc of substantially 180 degrees in a direction perpendicular to the 360 degree arc, said hoist ring assembly comprising:

a lift stud member having an enlarged end, a retainer end remote from said enlarged end, a flange protruding from said enlarged end, a generally cylindrical bearing surface extending between said retainer end and said flange, and a load bearing bore established through said enlarged end;

a bushing member having a generally cylindrical axial bore and an external threaded surface, said generally cylindrical bearing surface being axially received in said generally cylindrical axial bore;

a retainer element attachedly engaging said retainer end and captively and rotatably retaining said busing member between said flange and said retainer element, the external diameter of said retainer element being less than the external diameter of said bushing member;

a U-bar member having two opposed load bearing legs, each said leg including a U-bar bore, said U-bar bores being generally in axial alignment with one another; and a clevis pin element pivotally securing said U-bar member to said lift stud member by engaging said U-bar bores and said load bearing bore.

2. A hoist ring assembly capable of swiveling throughout a complete 360 degree arc and simultaneously capable of being swung throughout an arc of substantially 180 degrees in a direction perpendicular to the 360 degree arc, said hoist ring assembly comprising:

a lift stud member having an enlarged end, a retainer end, a generally cylindrical bearing surface, a generally circular flange, and a load bearing bore, said retainer end being remote from said enlarged end, said generally cylindrical bearing surface extending between said retainer end and said generally circular flange, said generally circular flange extending radially from said generally cylindrical bearing surface adjacent said enlarged end, said load bearing bore established through said enlarged end;

a bushing member having a generally cylindrical axial bore and an external threaded surface, said generally cylindrical bearing surface being axially received in said generally cylindrical axial bore, said bushing member including a mating surface to said flange, said mating surface including a circular recess, said flange being seated within and restrained from lateral movement by said circular recess;

a retainer element attachedly engaging said retainer end and captively and pivotally retaining said bushing member between said flange and said retainer element, the external diameter of said retainer element being less than the external diameter of said bushing member;

a U-bar member having two opposed load bearing legs, each said leg including a U-bar bore, said U-bar bores being generally in axial alignment with one another; and a clevis pin element pivotally securing said U-bar member to said lift stud member by engaging said U-bar bores and said load bearing bore.

3. A safety hoist ring comprising:

a lift stud member having an enlarged end, a securing end remote from said enlarged end, a generally cylindrical bearing surface extending generally between said securing end and said enlarged end, a flange adjacent said enlarged end, said enlarged end including a load engaging element, said load engaging element including a load bearing bore extending transversely through said enlarged end;

a bushing member having a generally cylindrical axial bore and an external object engaging element, said generally cylindrical bearing surface being axially received in said generally cylindrical axial bore, said bushing member including a mating surface to said flange;

a retainer element engaged with said securing end, said bushing member being confined between said retainer element and said flange, said lift stud member being rotatably mounted within said generally cylindrical axial bore; and a U-bar member having two opposed load bearing legs, each said leg including a U-bar bore, said U-bar bores being generally in axial alignment with one another; and a clevis pin element pivotally securing said U-bar member to said lift stud member by engaging said U-bar bores and said load bearing bore.

4. A safety hoist ring comprising:

a lift stud member having an enlarged end, a securing end remote from said enlarged end, a generally cylindrical bearing surface extending generally between said securing end and said enlarged end, a flange adjacent said enlarged end, said enlarged end including a load engaging element;

a bushing member having a generally cylindrical axial bore and an external object engaging element, said generally cylindrical bearing surface being axially received in said generally cylindrical axial bore, said bushing member including a mating surface to said flange, said mating surface having a circular recess, said flange being seated within said circular recess; and a retainer element engaged with said securing end, said bushing member being confined between said retainer element and said flange, said lift stud member being rotatably mounted within said generally cylindrical axial bore.

* * * * *